US011352835B2

(12) United States Patent
Tao

(10) Patent No.: US 11,352,835 B2
(45) Date of Patent: Jun. 7, 2022

(54) ROLLER AND INSERT PLATE-ASSISTED ROLLER SECURING DEVICE

(71) Applicant: SUNMASTER BLINDS CO., LTD., Kaohsiung (TW)

(72) Inventor: Yi-Chin Tao, Kaohsiung (TW)

(73) Assignee: Sunmaster Blinds Co., Ltd., Kaohsiung (TW)

( * ) Notice: Subject to any disclaimer, the term of this patent is extended or adjusted under 35 U.S.C. 154(b) by 0 days.

(21) Appl. No.: 17/005,777

(22) Filed: Aug. 28, 2020

(65) Prior Publication Data

US 2022/0065035 A1 Mar. 3, 2022

(51) Int. Cl.

| | |
|---|---|
| ***E06B 9/50*** | (2006.01) |
| ***E06B 9/44*** | (2006.01) |
| *A47H 1/13* | (2006.01) |

(52) U.S. Cl.

CPC ..... *E06B 9/44* (2013.01); *E06B 9/50* (2013.01); *A47H 1/13* (2013.01)

(58) Field of Classification Search

CPC ..... E06B 9/44; E06B 9/42; E06B 9/50; E06B 9/174; E06B 2009/1746; E06B 2009/785; A47H 1/13

See application file for complete search history.

(56) References Cited

U.S. PATENT DOCUMENTS

| | | | | |
|---|---|---|---|---|
| 8,505,609 | B2 * | 8/2013 | Huang | E06B 9/42 160/293.1 |
| 8,967,568 | B2 * | 3/2015 | Wills | E06B 9/50 248/269 |
| 9,347,261 | B2 * | 5/2016 | Blair | E06B 9/42 |
| 9,951,555 | B2 * | 4/2018 | Klein Tuente | A47H 1/142 |
| 10,428,580 | B2 * | 10/2019 | Vries | E06B 9/42 |
| 10,676,989 | B2 * | 6/2020 | Buccola, Jr. | H02K 7/003 |
| 10,704,324 | B2 * | 7/2020 | Goldberg | E06B 9/323 |
| 10,988,982 | B2 * | 4/2021 | Geiger | A47H 1/13 |
| 11,021,909 | B2 * | 6/2021 | Lai | E06B 9/60 |
| 2006/0049325 | A1 * | 3/2006 | Jung | E06B 9/50 248/266 |
| 2010/0219306 | A1 * | 9/2010 | Detmer | E06B 9/72 248/201 |
| 2015/0136338 | A1 * | 5/2015 | Lemaitre | H02K 11/33 160/310 |
| 2018/0023340 | A1 * | 1/2018 | Goldberg | E06B 9/56 160/324 |
| 2019/0162021 | A1 * | 5/2019 | De Vries | E06B 9/60 |
| 2020/0370367 | A1 * | 11/2020 | Jung | E06B 9/42 |

* cited by examiner

*Primary Examiner* — Johnnie A. Shablack
(74) *Attorney, Agent, or Firm* — Rosenberg, Klein & Lee

(57) ABSTRACT

A roller and an insert plate-assisted roller securing device are provided. The insert plate-assisted roller securing device includes a wheel-shaped cover, an outer cover, and a bracket. The outer cover has a supported portion with different widths in different directions, and the supported portion can be engaged in the bracket without separating from the bracket. As the outer cover can be coupled to the bracket along with the roller by a single person, installation of the roller is made easier and less time-consuming than before.

8 Claims, 18 Drawing Sheets

ROLLER AND INSERT PLATE-ASSISTED ROLLER SECURING DEVICE

BACKGROUND OF THE INVENTION

1. Technical Field

The present invention relates to a roller and a roller securing device. More particularly, the invention relates to a roller and an insert plate-assisted roller securing device.

2. Description of Related Art

When installing a roller blind, it is common practice to secure a pair of L-shaped brackets to the ceiling or wherever the roller blind is to be secured, before the roller blind is mounted on the brackets through engagement between corresponding posts and grooves. To prevent the posts from sliding off their respective grooves and thereby causing the roller blind to fall off, the posts and grooves are typically small and are tightly engaged with each other. As roller blinds can be quite bulky and heavy, it is difficult for a single person to hold up a roller blind continuously, let alone align each post with the corresponding groove and insert the former into the latter, during the roller blind installation process; the joint efforts of at least two people are generally required.

In view of the above, Taiwan Patent No. M415668 provides an improved quick mounting and quick dismounting structure for a roller blind bracket. The quick mounting and quick dismounting structure includes a rotatable disc, a coupling disc, and a bracket. The rotatable disc has a receiving space whose opening-end edge is circumferentially provided with a plurality of fastening ribs, and whose opening side is protrudingly provided with a pivot shaft, with a plurality of positioning protuberances provided around and adjacent to the pivot shaft, and a position-limiting flange provided round and outward of the positioning protuberances. The coupling disc is peripherally provided with an engaging edge to be engaged with the fastening ribs, and one side of the coupling disc is concavely provided with a pivot groove, in which the pivot shaft is pivotally received. A plurality of positioning holes are provided around and adjacent to the pivot groove, and a position-limiting slide groove is provided around and outward of the positioning holes, wherein the positioning holes and the position-limiting slide groove are configured to engage with the positioning protuberances and the position-limiting flange of the rotatable disc respectively. The foregoing structure is so designed that the fastening ribs of the rotatable disc can be tightly fastened to the engaging edge on the outer periphery of the coupling disc to provide preliminary position limitation, and that the position-limiting flange of the rotatable disc can then be tightly engaged with the position-limiting slide groove of the coupling disc to provide double limitation in position, thereby achieving enhanced structural stability during use.

According to the patent cited above, a shaft member on a sealing cap of a roller blind must be placed into the aligned recesses of the rotatable disc, the coupling disc, and the bracket in order to be pivotally mounted in the aligned pivot holes of the rotatable disc and the coupling disc. The securing method of the afore-cited patent, therefore, cannot be applied to a roller blind without a protruding shaft member.

BRIEF SUMMARY OF THE INVENTION

In light of the above, the inventor of the prevent invention presents an insert plate-assisted roller securing device to be provided at one end of a roller. The insert plate-assisted roller securing device includes a wheel-shaped cover, an outer cover, and a bracket. The wheel-shaped cover is coupled to the roller. The outer cover is coupled to the wheel-shaped cover and has a supported portion. The supported portion has a first width in a first radial direction of the outer cover and a second width in a second radial direction of the outer cover. The bracket has a securing space for receiving the supported portion of the outer cover and a gap in communication with the securing space. The width of the gap is less than the greatest width of the securing space. The first width is in a range between the width of the gap and the greatest width of the securing space. The second width is less than or substantially equal to the width of the gap.

Preferably, the insert plate-assisted roller securing device further includes an insert plate. The insert plate is coupled between the outer cover and the wheel-shaped cover and corresponds to the bracket and the supported portion.

Preferably, the wheel-shaped cover has at least one hole, and the insert plate has a protuberance corresponding to and engaged in the hole.

Preferably, the wheel-shaped cover has a first indicator portion, a second indicator portion, a third radial direction, and a fourth radial direction; the at least one hole includes a hole in the diametrically opposite radial direction of third radial direction and a hole in the fourth radial direction; and the outer cover has a window. When the first radial direction coincides with the third radial direction, the window corresponds to the first indicator portion, and the protuberance of the insert plate corresponds to and is engaged in the hole in the fourth radial direction. When the second radial direction coincides with the third radial direction, the window corresponds to the second indicator portion, and the protuberance of the insert plate corresponds to and is engaged in the hole in the diametrically opposite radial direction of the third radial direction.

Preferably, the outer cover has a position-limiting wall; and the position-limiting wall, the supported portion, and the wheel-shaped cover form a position-limiting space. When the supported portion is coupled in the securing space and the insert plate is coupled between the outer cover and the wheel-shaped cover, both the bracket and the insert plate extend into the position-limiting space.

Preferably, the bracket has two opposing abutment surfaces adjacent to the gap, and the insert plate has a first lateral edge corresponding to the supported portion and a second lateral edge corresponding to one of the abutment surfaces.

Preferably, the wheel-shaped cover has a first tubular portion, and the outer cover has a second tubular portion. The second tubular portion of the outer cover extends into the first tubular portion of the wheel-shaped cover.

Preferably, the first tubular portion has a first coupling portion, and the second tubular portion has a second coupling portion. The first coupling portion and the second coupling portion are coupled together when the second tubular portion of the outer cover extends into the first tubular portion of the wheel-shaped cover.

The inventor also presents a roller that includes a roller body in addition to the foregoing insert plate-assisted roller securing device.

The technical features stated above can produce the following effects:

1. The first width and the second width of the supported portion make it possible for a single person to couple the outer cover to the bracket along with the roller so that the roller can be installed more easily and more rapidly than conventionally allowed.

2. The engagement between the protuberance and the corresponding hole ensures that the outer cover is secured in place by the insert plate and cannot be rotated, and this contributes to the safety of the roller.

3. Depending on the location of the bracket, the window will correspond to the first indicator portion or the second indicator portion to satisfy the need to mount the bracket on a ceiling or a wall.

DETAILED DESCRIPTION OF THE INVENTION

The technical features stated above are incorporated into the roller and the insert plate-assisted roller securing device of the present invention, whose major effects are demonstrated by the following embodiments.

Figure 1:
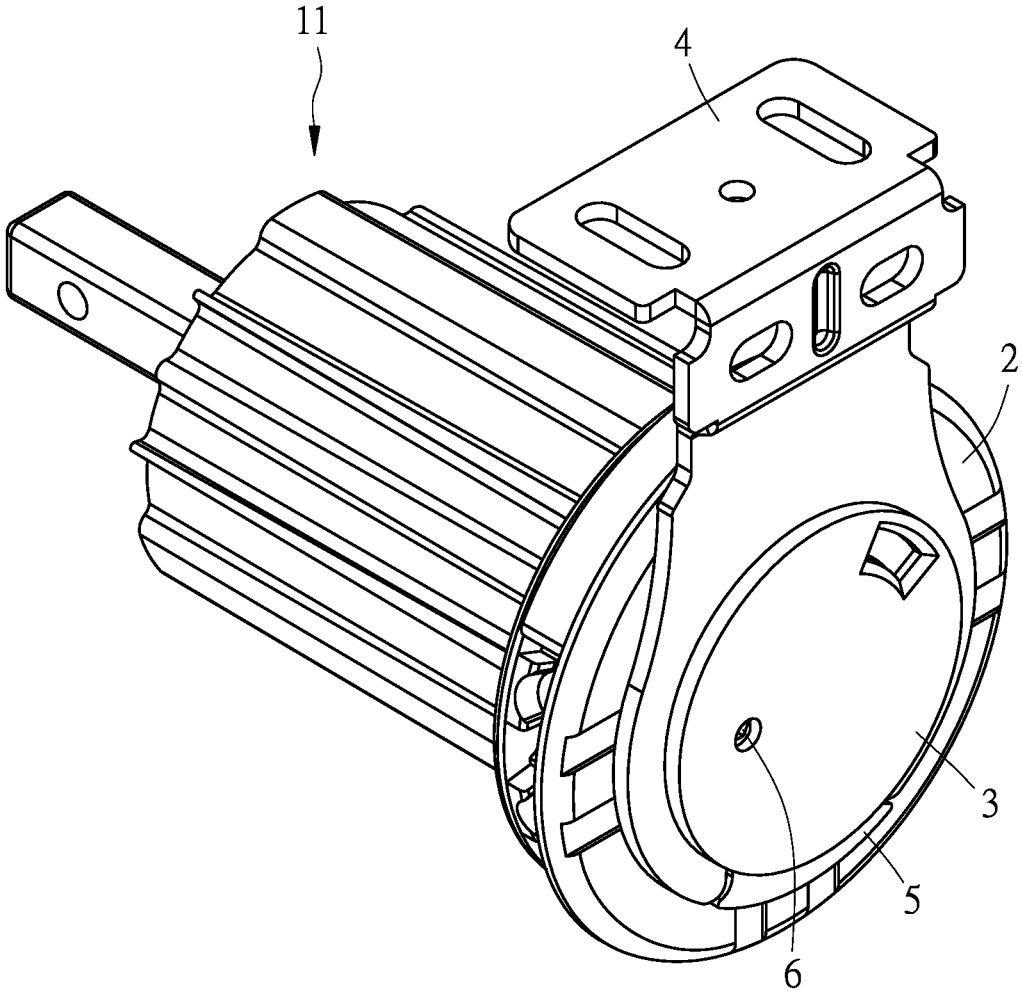
FIG. 1 is an assembled perspective view of the first embodiment of the present invention, wherein the first embodiment is in a first assembled state.
Figure 2:
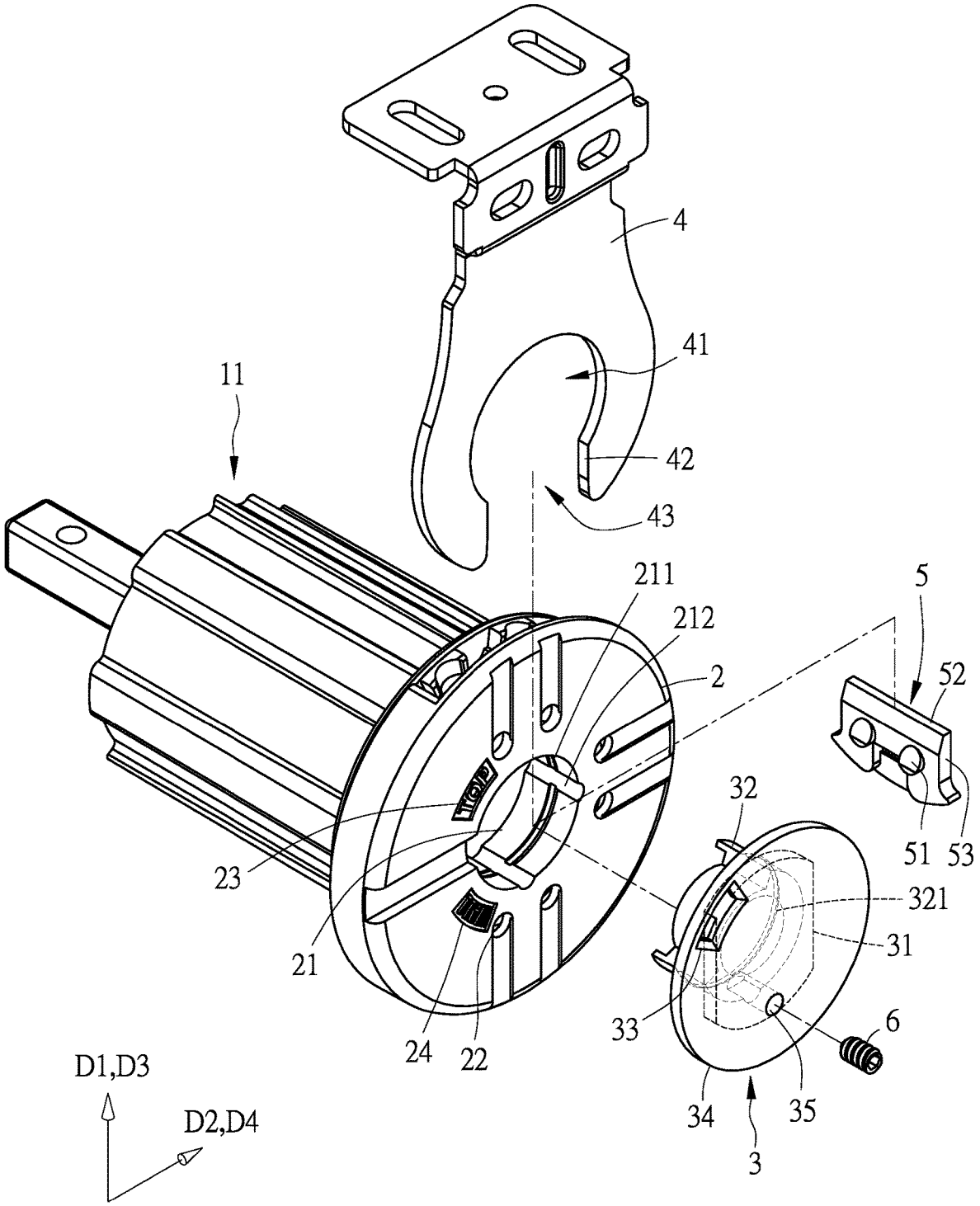
FIG. 2 is an exploded perspective view of the first embodiment of the present invention and corresponds to the first assembled state.
Figure 3:
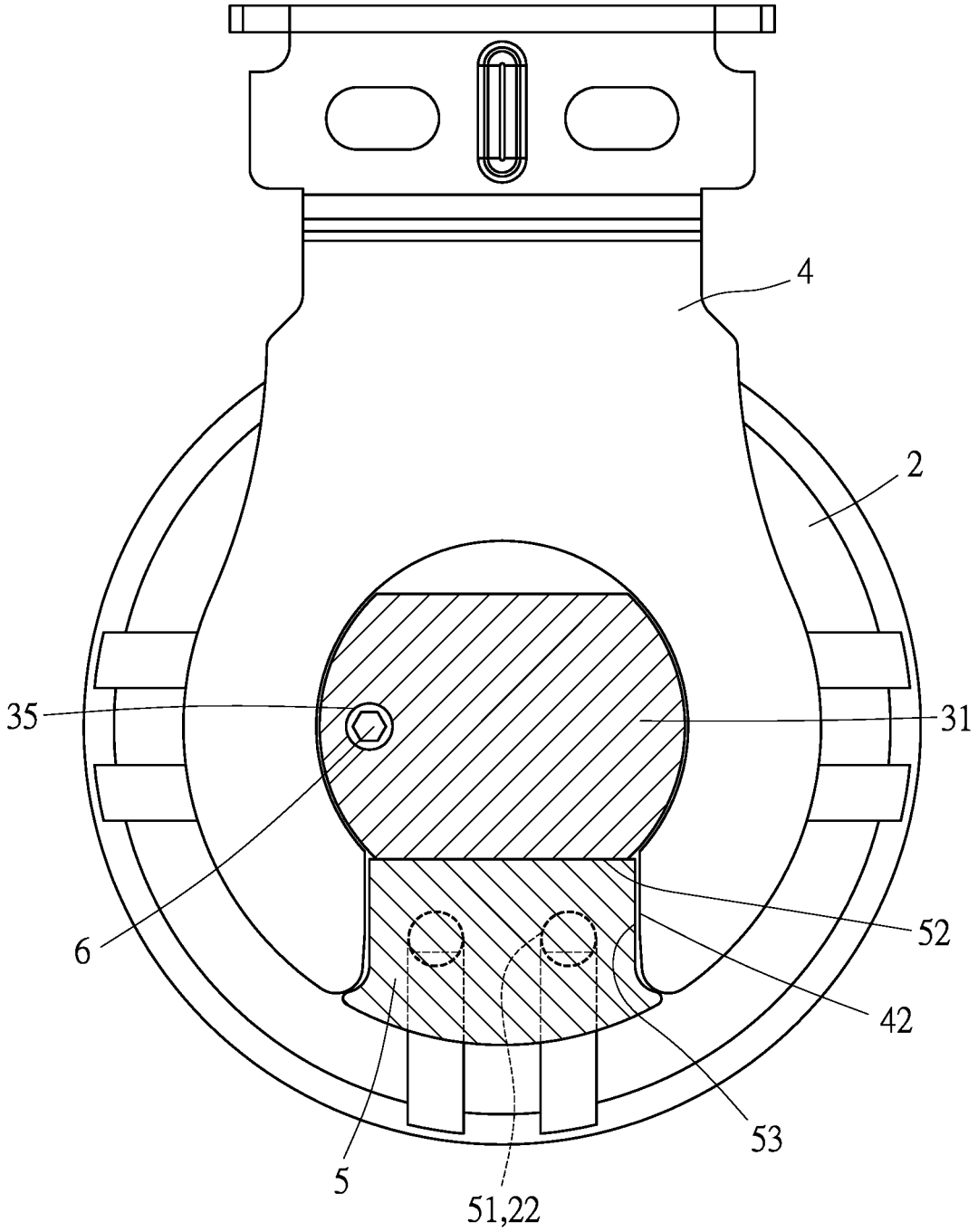
FIG. 3 is a sectional view of the first embodiment of the present invention in the first assembled state.
Figure 4:
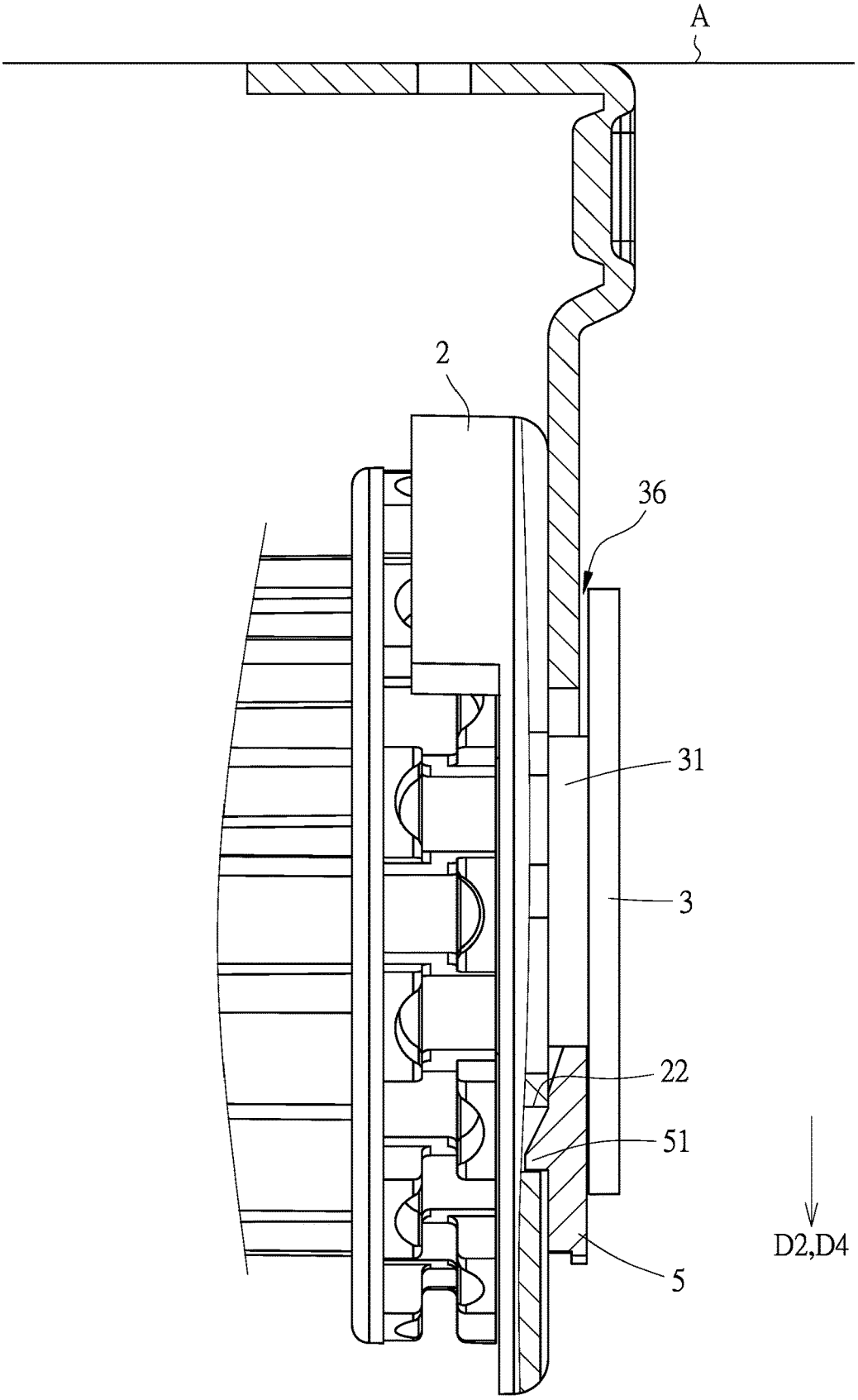
FIG. 4 is another sectional view of the first embodiment of the present invention in the first assembled state.
Figure 5:
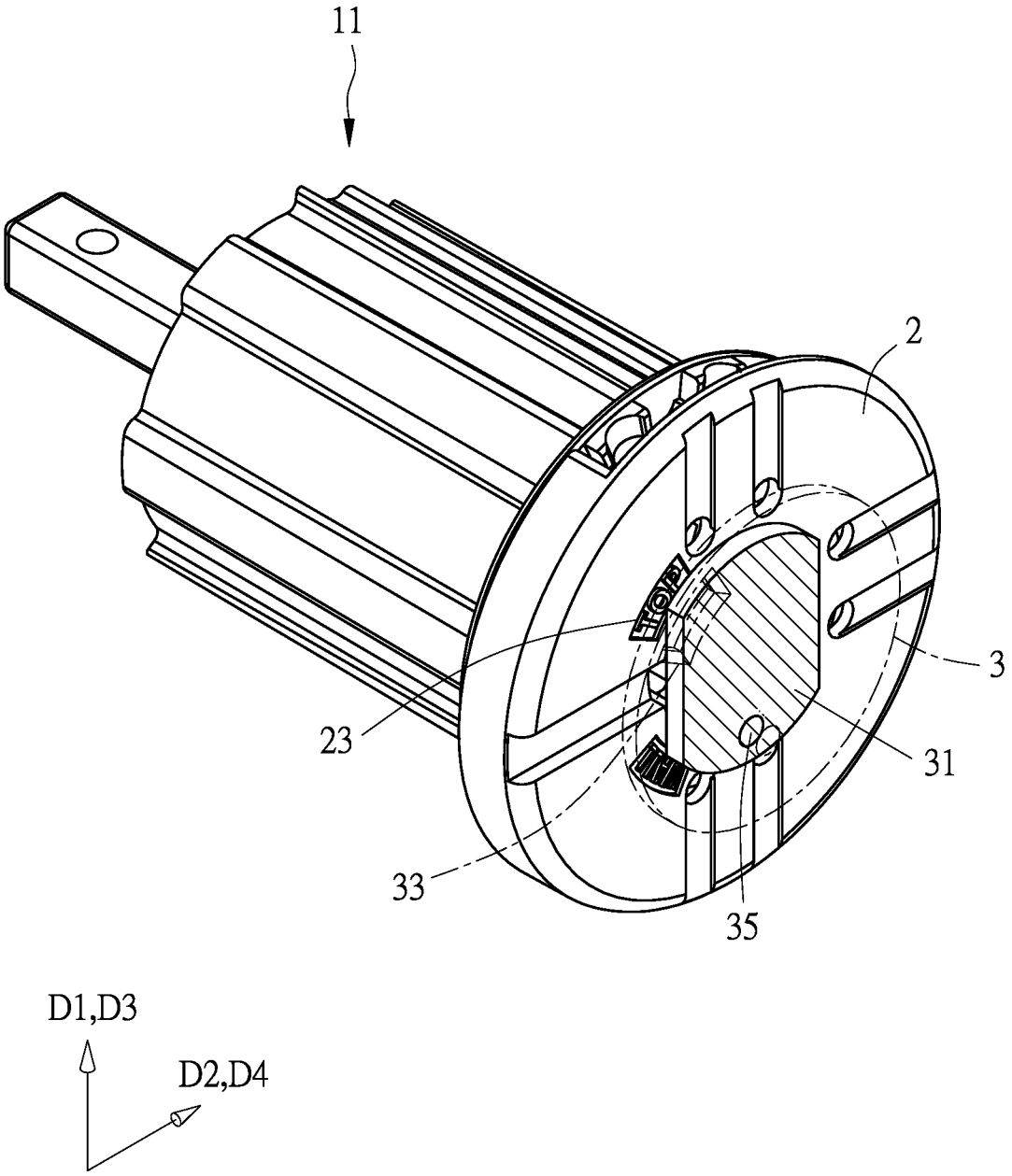
FIG. 5 shows a state of use of the first embodiment of the present invention in the first assembled state.
Figure 6:
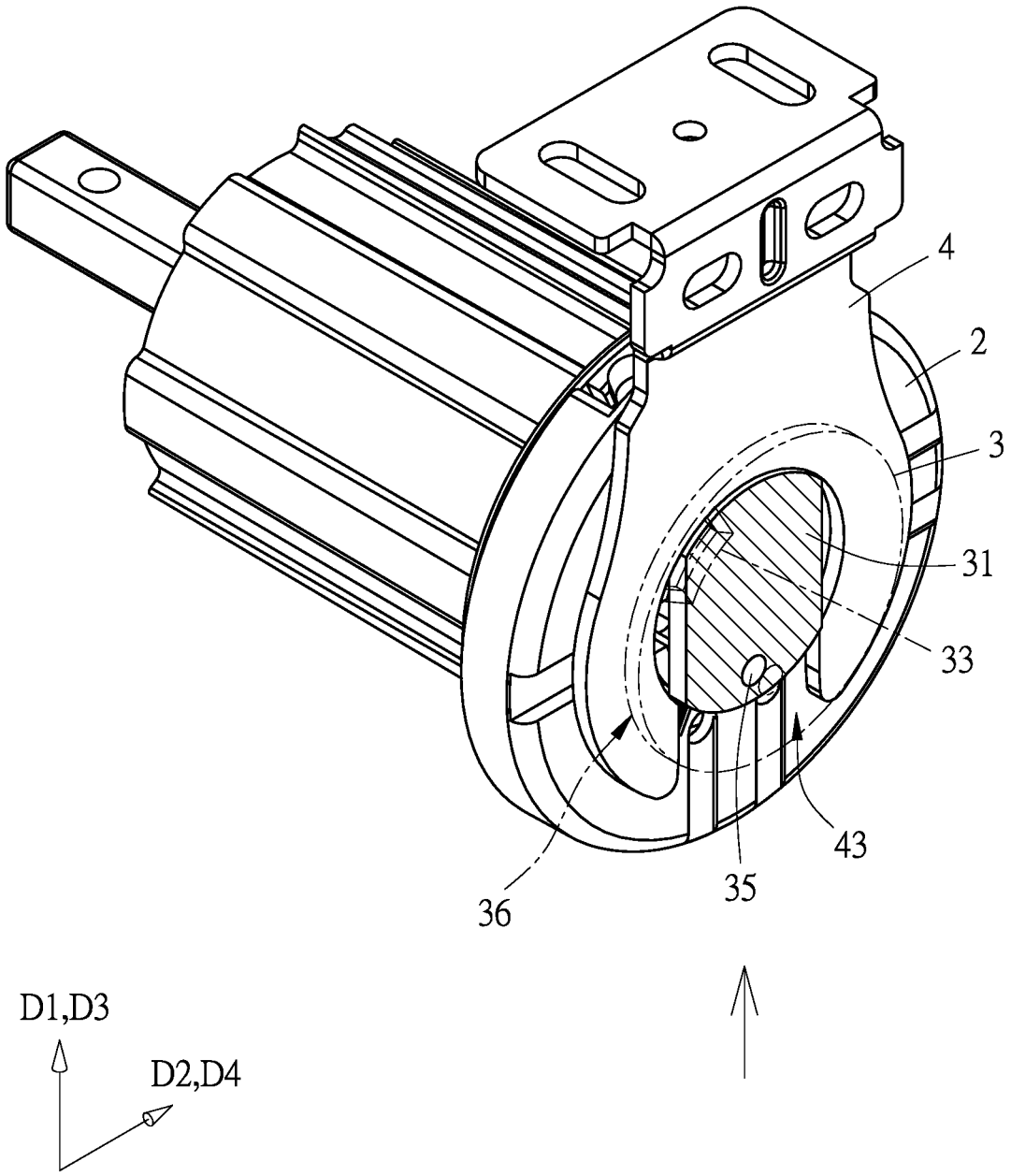
FIG. 6 shows another state of use of the first embodiment of the present invention in the first assembled state.
Figure 7:
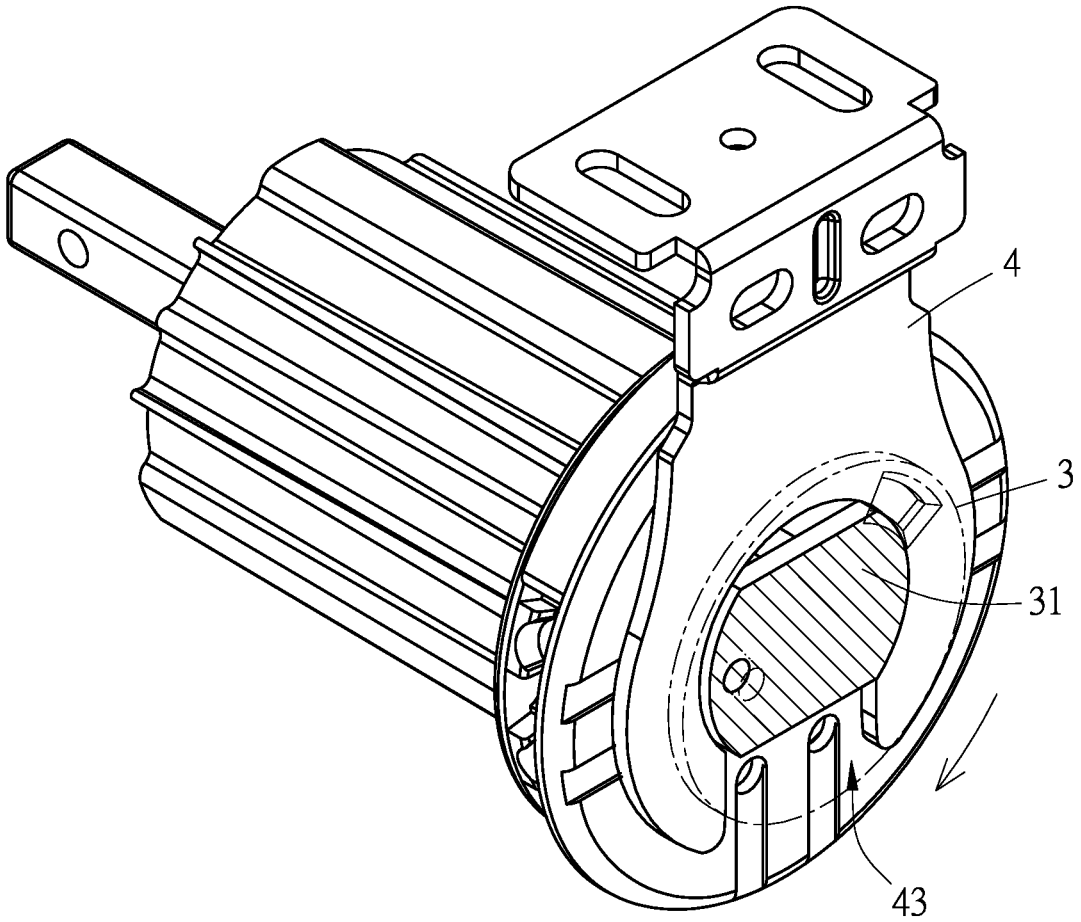
FIG. 7 shows still another state of use of the first embodiment of the present invention in the first assembled state.
Figure 7:
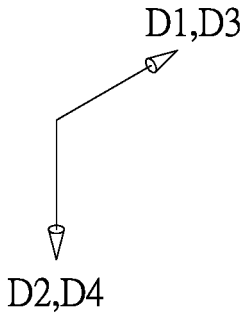
Figure 8:
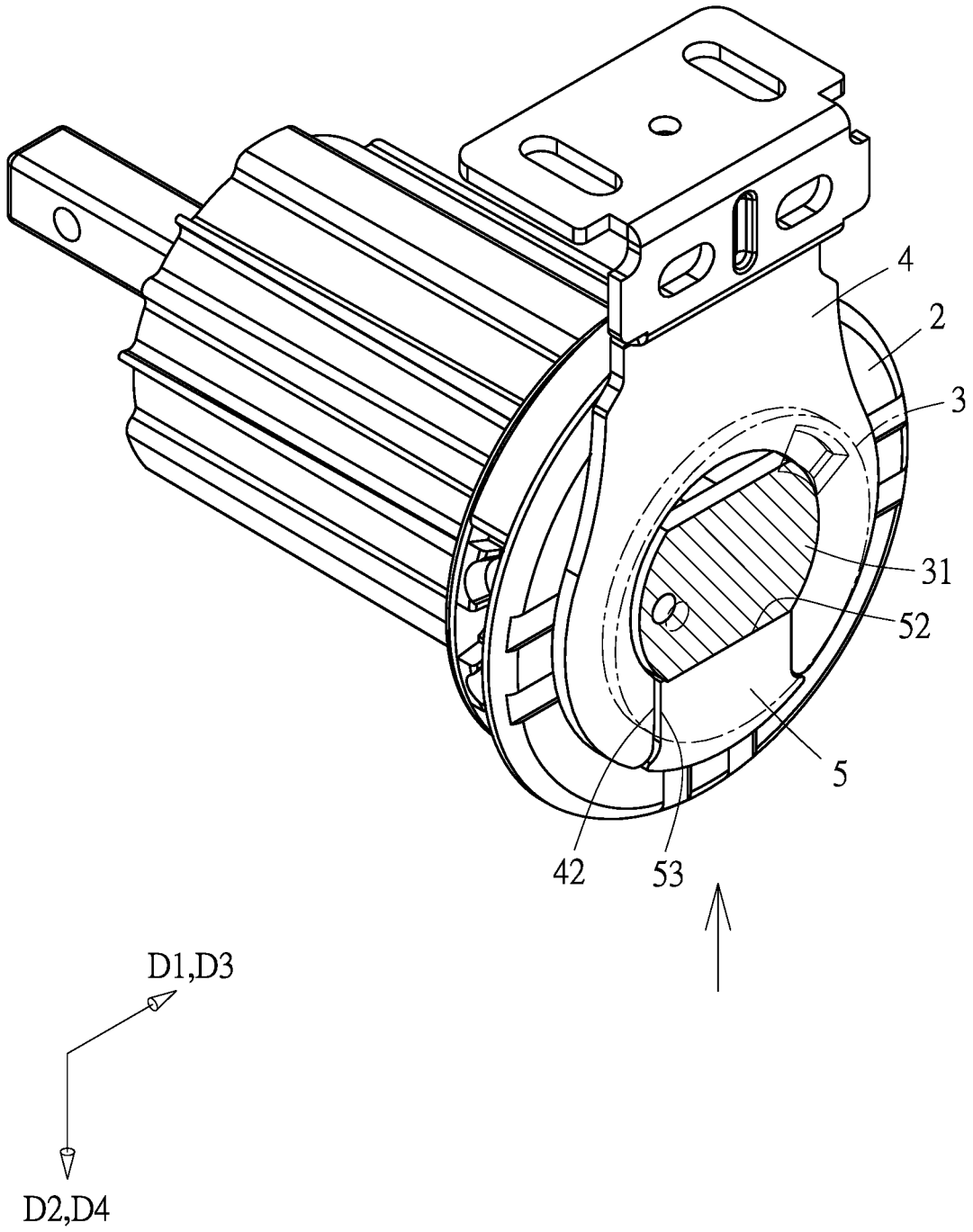
FIG. 8 shows yet another state of use of the first embodiment of the present invention in the first assembled state.
Figure 9:
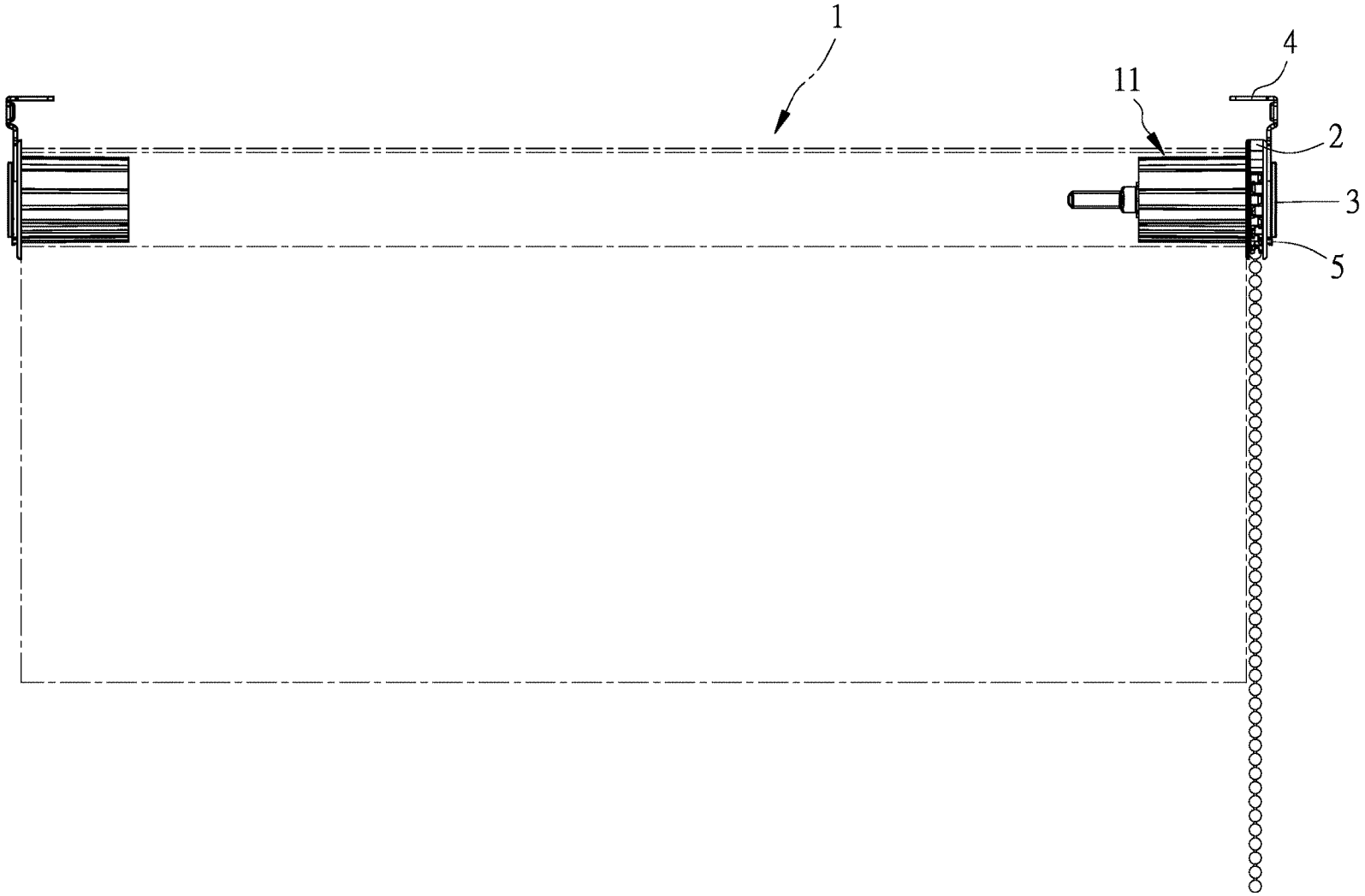
FIG. 9 shows an application of the first embodiment of the present invention in the first assembled state.
Figure 10:
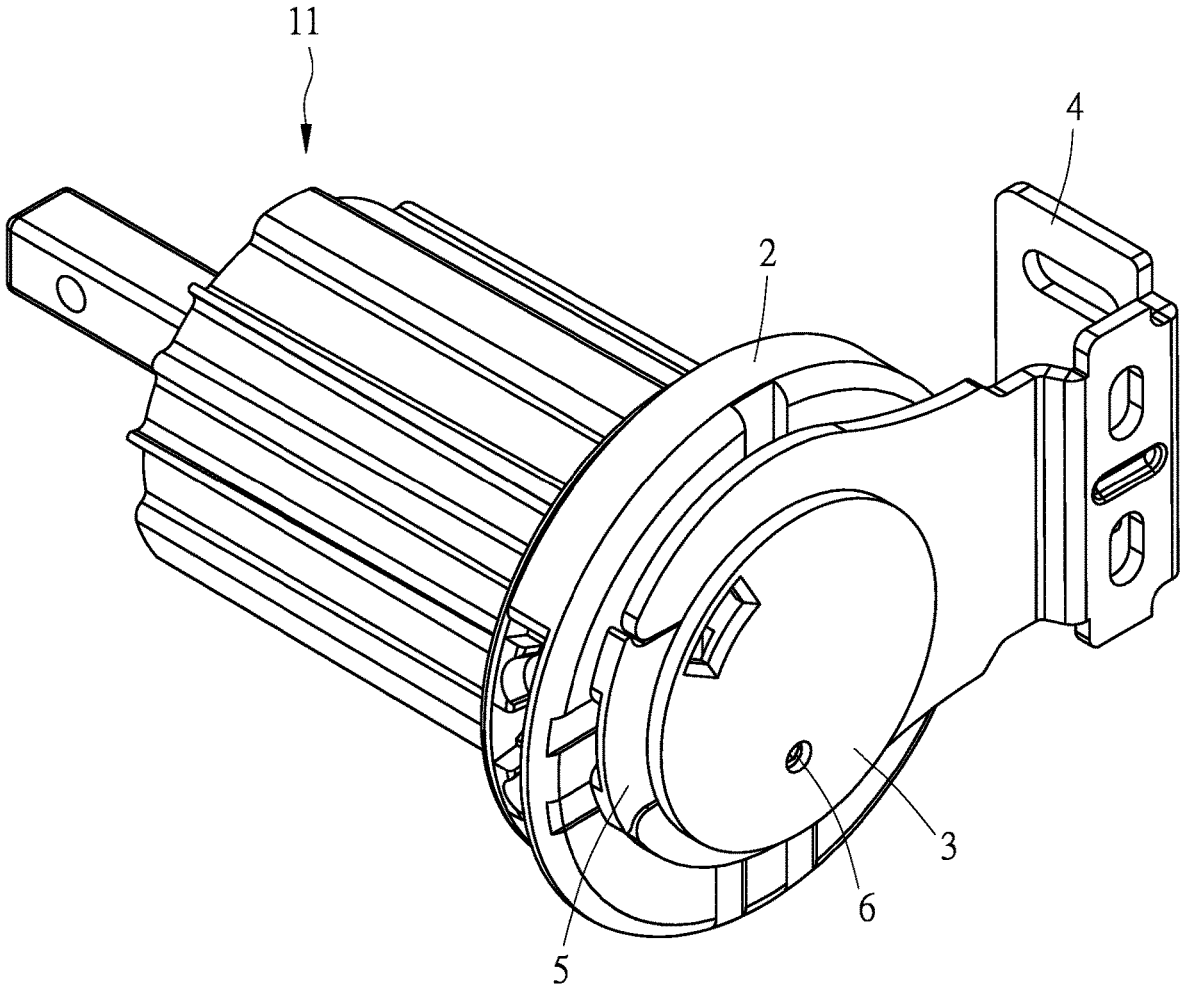
FIG. 10 is another assembled perspective view of the first embodiment of the present invention, wherein the first embodiment is in a second assembled state.
Figure 11:
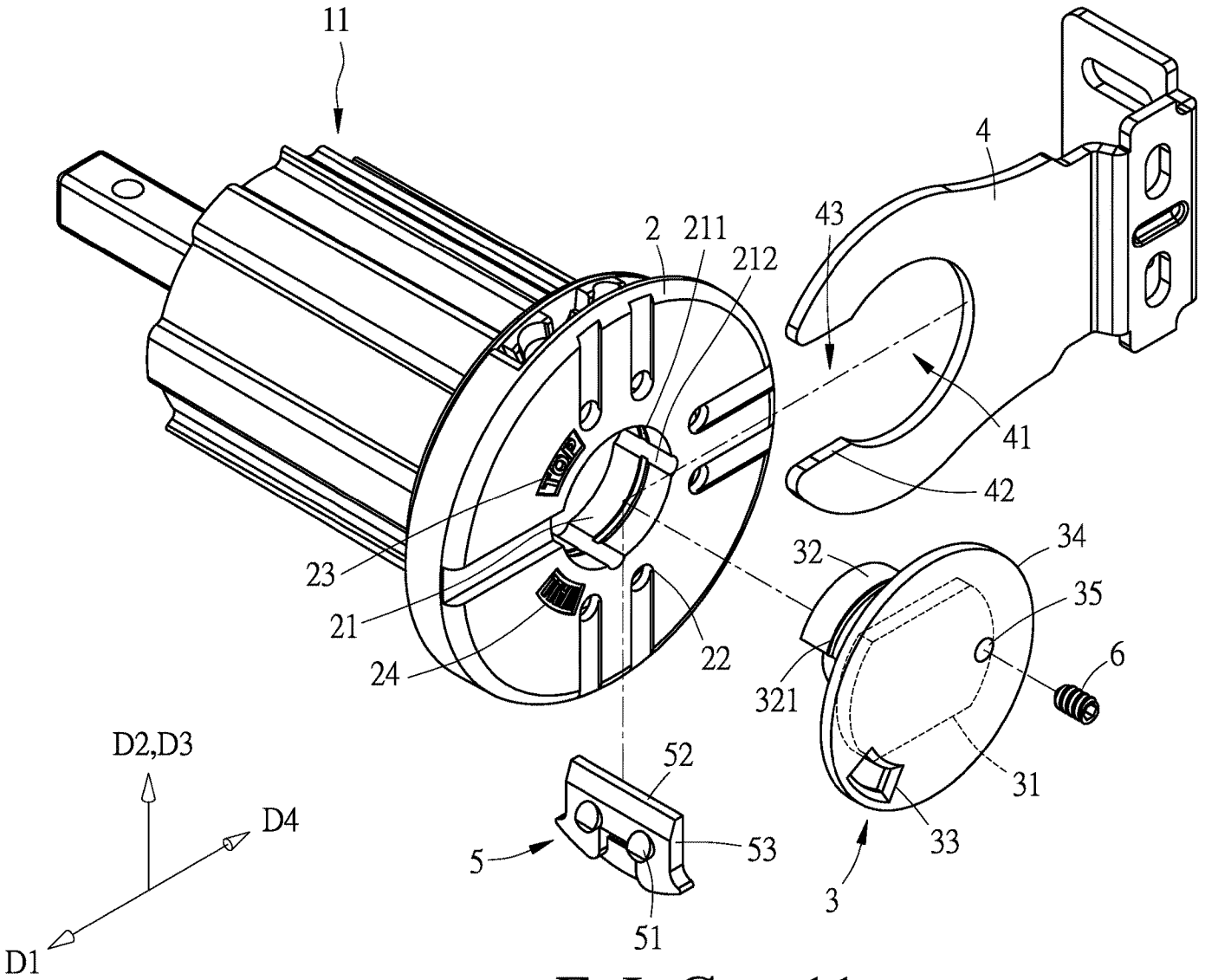
FIG. 11 is another exploded perspective view of the first embodiment of the present invention and corresponds to the second assembled state.
Figure 12:
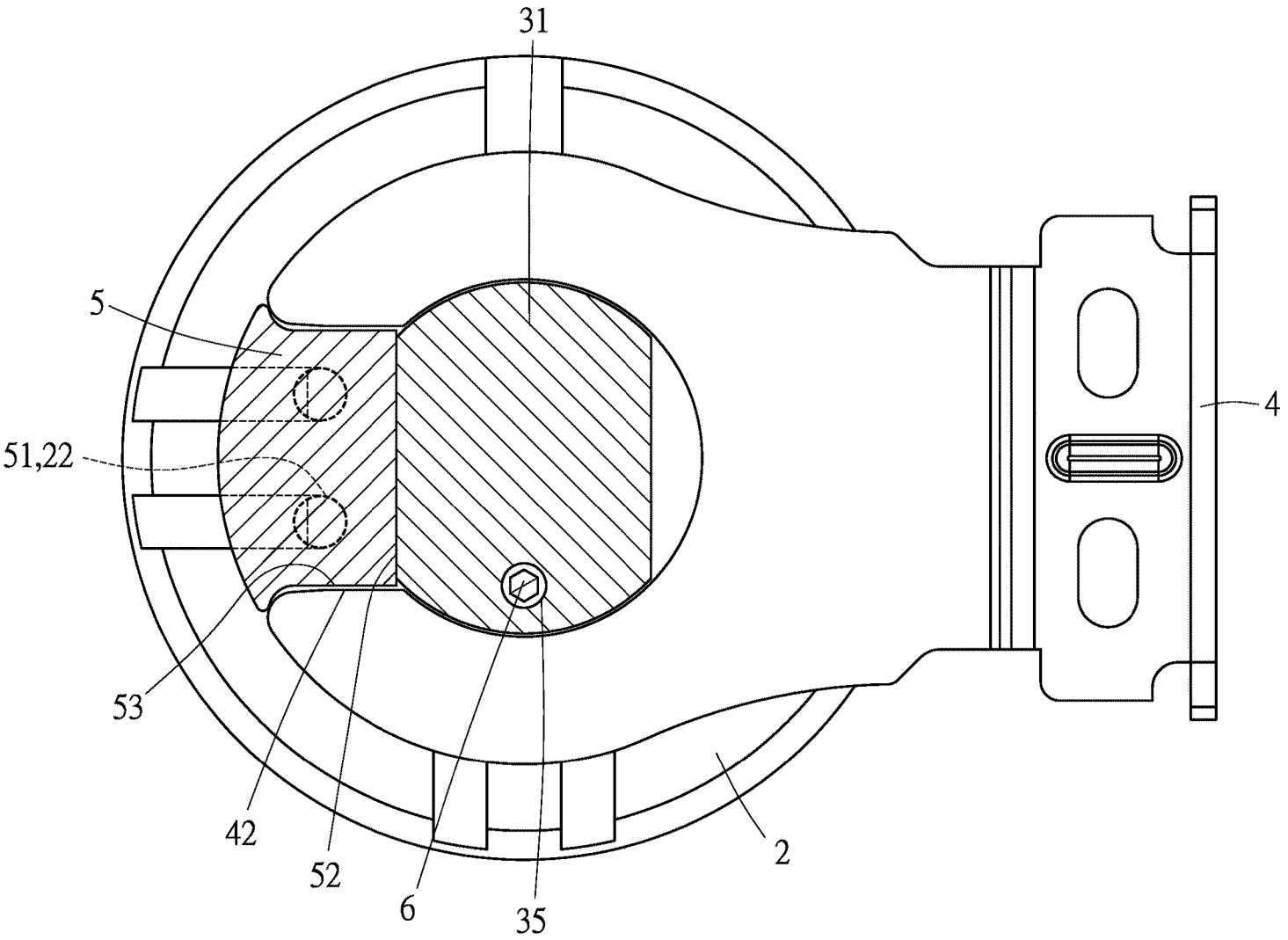
FIG. 12 is a sectional view of the first embodiment of the present invention in the second assembled state.
Figure 13:
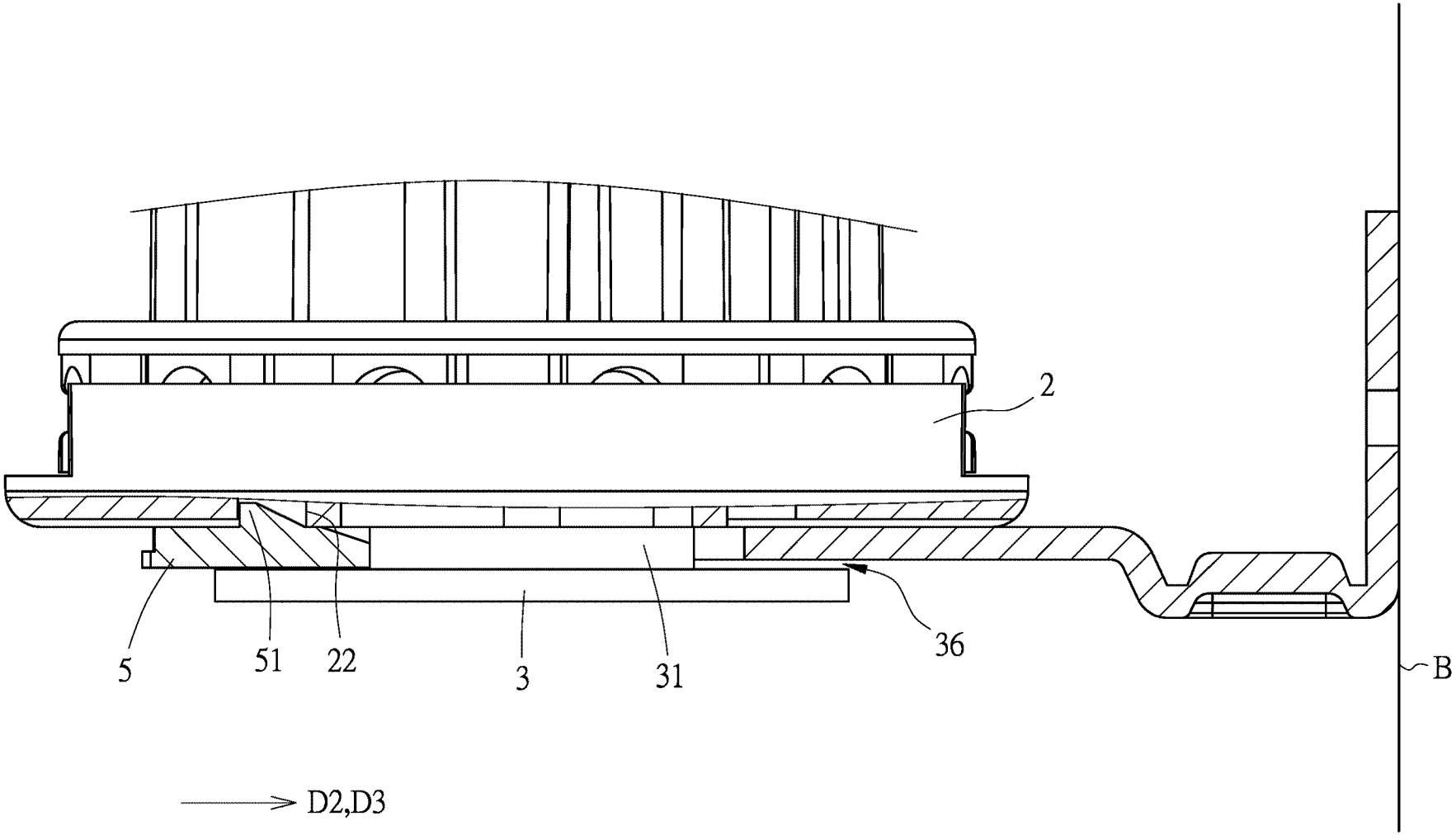
FIG. 13 is another sectional view of the first embodiment of the present invention in the second assembled state.
Figure 14:
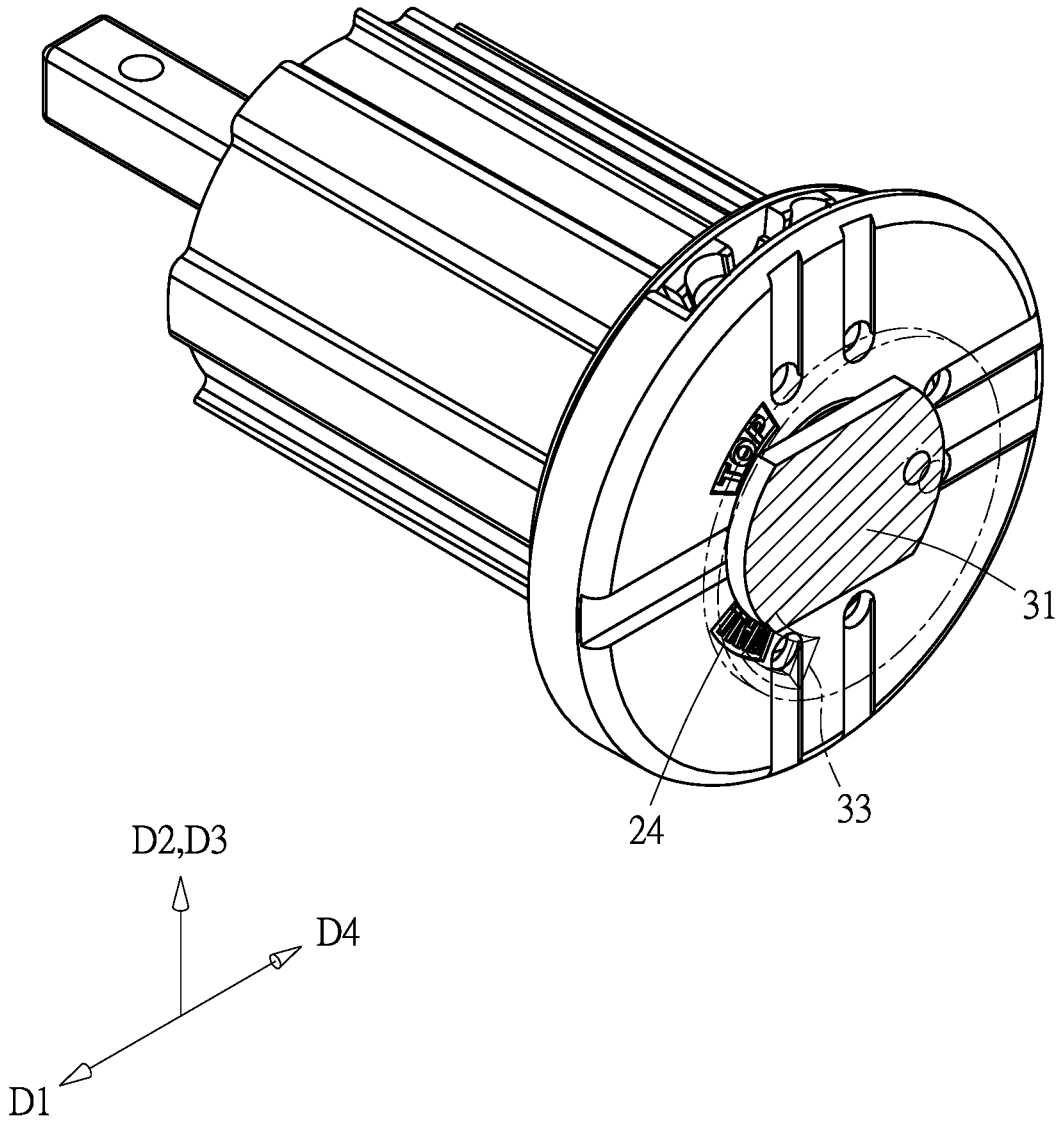
FIG. 14 shows a state of use of the first embodiment of the present invention in the second assembled state.
Figure 15:
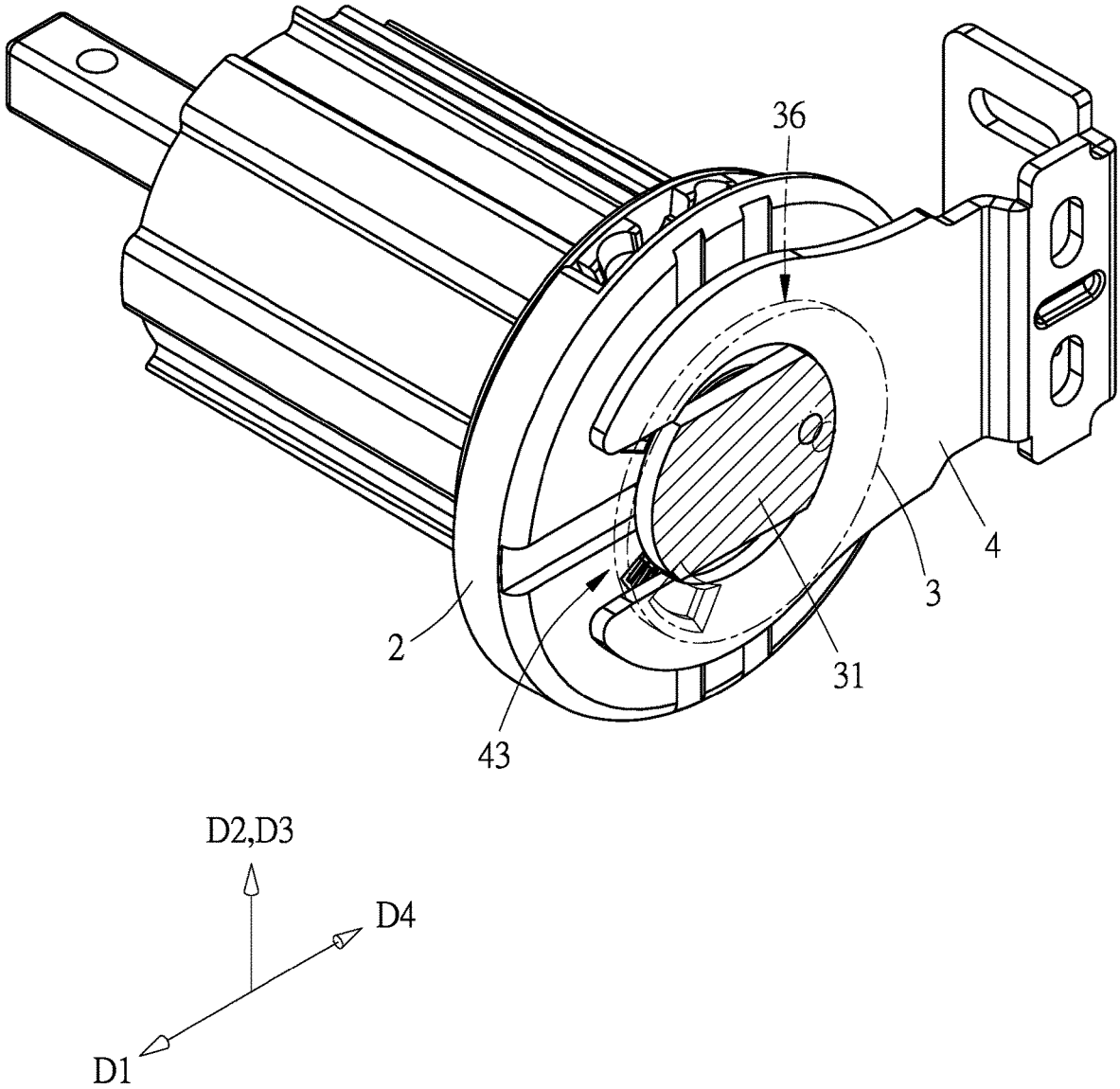
FIG. 15 shows another state of use of the first embodiment of the present invention in the second assembled state.
Figure 16:
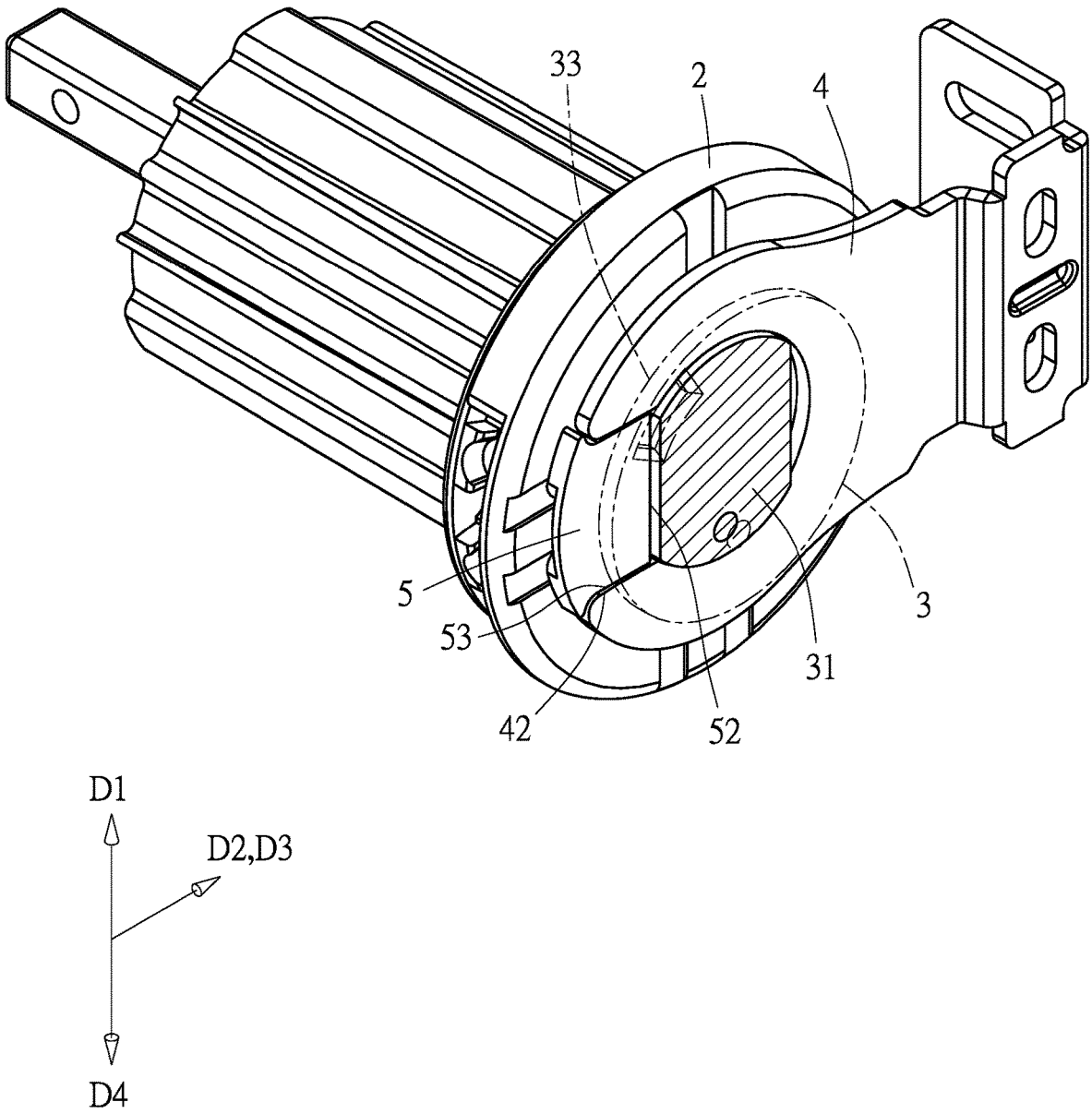
FIG. 16 shows still another state of use of the first embodiment of the present invention in the second assembled state.

Please refer to FIG. 1 to FIG. 3 for the first assembled state of the first embodiment of the roller of the present invention. The roller includes a roller body 1 (see FIG. 9) and an insert plate-assisted roller securing device coupled to the roller body 1. The roller body 1 includes a manually operated control assembly 11. The insert plate-assisted roller securing device essentially includes a wheel-shaped cover 2, an outer cover 3, a bracket 4, and an insert plate 5. The outer cover 3 has a first radial direction D1 and a second radial direction D2, and the wheel-shaped cover 2 has a third radial direction D3 and a fourth radial direction D4.

The wheeled-shaped cover 2 is coupled to the control assembly 11 to replace the original wheeled-shaped cover that has a bead chain. The wheel-shaped cover 2 has a first tubular portion 21, a plurality of holes 22 that are arranged in pairs, a first indicator portion 23, and a second indicator portion 24. The first tubular portion 21 extends toward the roller body 1. The first tubular portion 21 has a first coupling portion 211 and two first grooves 212. The holes 22 are provided respectively in the third radial direction D3, the diametrically opposite radial direction of the third radial direction D3, and the fourth radial direction D4, and the first grooves 212 are provided respectively in the diametrically opposite radial direction of the third radial direction D3 and the fourth radial direction D4. The first coupling portion 211 is a furrow, the first grooves 212 are semi-cylindrical grooves, the first indicator portion 23 is the text "TOP", and the second indicator portion 24 is the text "WALL". In practice, however, the first coupling portion 211, the first grooves 212, the first indicator portion 23, and the second indicator portion 24 are not necessarily implemented as such.

The outer cover 3 is coupled to the wheel-shaped cover 2 and has a supported portion 31, a second tubular portion 32, a window 33, a position-limiting wall 34, and a second groove 35. The supported portion 31 has a first width in the first radial direction D1 and a second width in the second radial direction D2. The wheel-shaped cover 2, the position-limiting wall 34, and the supported portion 31 form a position-limiting space 36. The second groove 35 penetrates the outer cover 3 and forms a semi-cylindrical groove in the second tubular portion 32. This semi-cylindrical groove and each of the first grooves 212 in the wheel-shaped cover 2 can form a complete cylindrical hole through which a self-tapping screw 6 can be driven. The second tubular portion 32 has a second coupling portion 321 that is formed as a rib.

The bracket 4 has a securing space 41 and two opposing abutment surfaces 42 adjacent to a gap 43. The gap 43 is in communication with the securing space 41, and the width of the gap 43 is less than the greatest width of the securing space 41. Moreover, the first width is in a range between the width of the gap 43 and the greatest width of the securing space 41, and the second width is less than or substantially equal to the width of the gap 43.

To install the roller of the present invention, referring to FIG. 2, FIG. 4 to FIG. 6, and FIG. 9, the bracket 4 is locked with a threaded member to the ceiling A where the roller is to be mounted, with the gap 43 of the bracket 4 located on the bottom side of the bracket 4. The wheel-shaped cover 2 is coupled to the control assembly 11, and then the outer cover 3 is oriented to align the first radial direction D1 with the third radial direction D3 (or more specifically to make the first radial direction D1 coincide with the third radial direction D3) such that the window 33 of the outer cover 3 corresponds to the first indicator portion 23 of the wheel-shaped cover 2, i.e., the text "TOP".

After that, the second coupling portion 321 is brought into engagement with the first coupling portion 211, and the self-tapping screw 6 is subsequently driven into the second groove 35 and the first groove 212 in the diametrically opposite radial direction of the third radial direction D3 to fixedly couple the wheel-shaped cover 2 and the outer cover 3 together. The outer cover 3 is then rotated together with the roller body 1 until the first radial direction D1 points upward and corresponds to the gap 43 of the bracket 4, and the supported portion 31 is placed into the securing space 41 of the bracket 4 through the gap 43, whose width is greater than or substantially equal to the second width of the supported portion 31. Consequently, the bracket 4 is inserted into the position-limiting space 36.

Next, referring to FIG. 2, FIG. 4, and FIG. 7 to FIG. 9, the outer cover 3 is rotated again together with the roller body 1 until the second radial direction D2 corresponds to the gap 43 of the bracket 4. Now, with the first width of the supported portion 31 being in a range between the width of the gap 43 and the greatest width of the securing space 41, the supported portion 31 is restricted by the bracket 4. In the axial direction of the roller body 1, the bracket 4 blocks the wheel-shaped cover 2 as well as the position-limiting wall 34 of the outer cover 3 such that the roller body 1 is effectively limited in position along the axial direction of the roller body 1. A single person, therefore, will be able to couple the outer cover 3 to the bracket 4 along with the roller body 1, and this helps facilitate and expedite the installation of the roller.

The installation process is concluded by inserting the insert plate 5 into the position-limiting space 36, with the two protuberances 51 of the insert plate 5 slid into and eventually engaged with the two holes 22 in the fourth radial direction D4 respectively. As a result, a first lateral edge 52 of the insert plate 5 abuts against the supported portion 31, and a second lateral edge 53 of the insert plate 5 corresponds to one of the abutment surfaces 42. The outer cover 3 is now blocked by the insert plate 5 and is securely positioned against rotation. Preferably, the top portion of each protuberance 51 is tilted relatively smoothly on the side near the first lateral edge 52 and relatively steeply on the side facing away from the first lateral edge 52, the objective being to make it easier to bring each protuberance 51 into engagement with the corresponding hole 22 while preventing the protuberances 51 from sliding out of the corresponding holes 22 respectively.

Please refer to FIG. 10 to FIG. 13 for the second assembled state of the first embodiment of the roller of the present invention. When the bracket 4 is mounted horizontally on a vertical wall B, the gap 43 of the bracket 4 is located on a lateral side of the bracket 4. The roller installation process then continues by coupling the wheel-shaped cover 2 to the control assembly 11 and orienting the outer cover 3 to align the first radial direction D1 with the fourth radial direction D4 (or more specifically to make the first radial direction D1 coincide with the diametrically opposite radial direction of the fourth radial direction D4) such that the window 33 of the outer cover 3 corresponds to the second indicator portion 24 of the wheel-shaped cover 2, i.e., the text "WALL". Following that, the self-tapping screw 6 is driven into the second groove 35 of the outer cover 3 and the first groove 212 in the fourth radial direction D4.

The remainder of the roller installation process is similar to that corresponding to the first assembled state. Referring to FIG. 13 to FIG. 16, the outer cover 3 is rotated together with the roller body 1 (see FIG. 9 for the roller body 1) to make the first radial direction D1 point to the side and face away from the gap 43 of the bracket 4. After that, the supported portion 31 is placed into the securing space 41 through the gap 43.

The outer cover 3 is then rotated again along with the roller body 1 until the second radial direction D2 corresponds to the gap 43 of the bracket 4. As a result, the supported portion 31 is restricted by the bracket 4 and is kept from moving away from the securing space 41 through the gap 43.

To complete the installation process, the insert plate 5 is inserted into the position-limiting space 36, with the protuberances 51 of the insert plate 5 slid into and eventually engaged with the holes 22 in the diametrically opposite radial direction of the third radial direction D3 respectively. It should be pointed out that whether the wall B is on the left or right side of the wheel-shaped cover 2, the window 33 can always correspond to the second indicator portion 24 when the outer cap 3 is properly mounted, and the mounted portion 31 can be placed into the securing space 41 the other way around to ensure that the insert plate 5 will be on the side facing away from the wall B.

Figure 17:
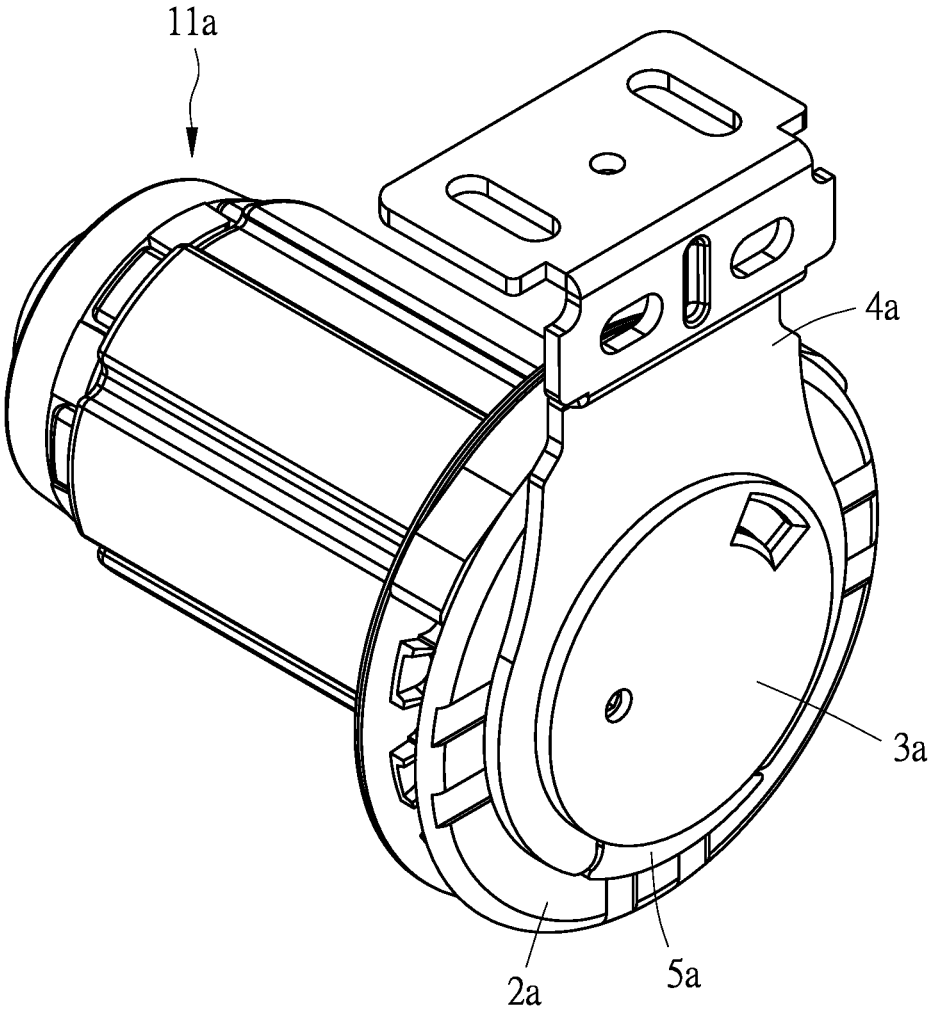
FIG. 17 is an assembled perspective view of the second embodiment of the present invention.
Figure 18:
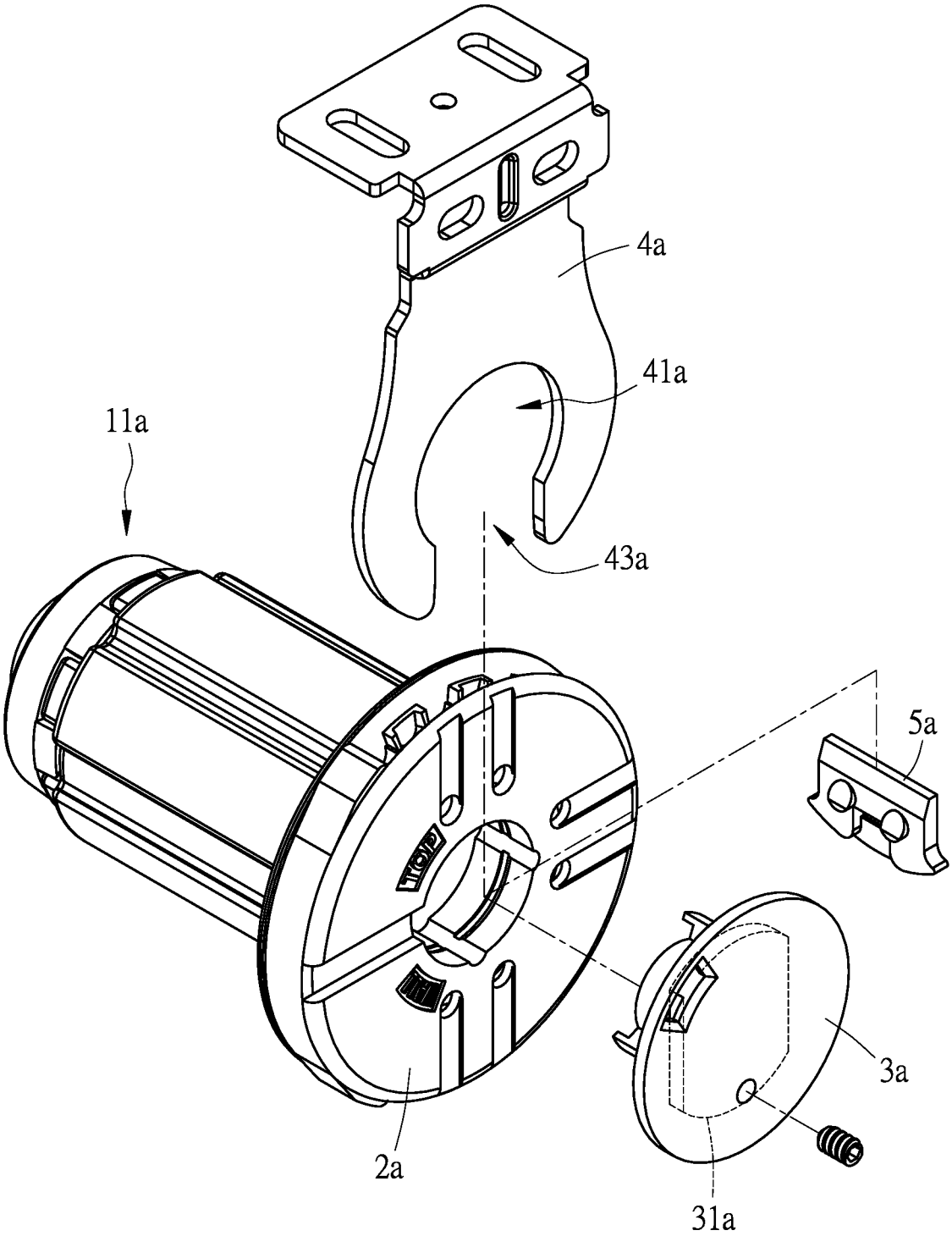
FIG. 18 is an exploded perspective view of the second embodiment of the present invention.

Please refer to FIG. 17 and FIG. 18 for the second embodiment of the roller of the present invention. This embodiment is different from the first embodiment in that the control assembly 11 in the first embodiment is manually operated whereas the control assembly 11*a* in the second embodiment is electrically driven. Like the first embodiment, the second embodiment has a first assembled state and a second assembled state so that the roller can be mounted on not only the ceiling A (see FIG. 4) but also the wall B (see FIG. 13). The roller installation process begins by coupling the wheel-shaped cover 2*a* to the control assembly Ila. Next, the outer cover 3*a* is coupled to the wheel-shaped cover 2*a* and then rotated to allow the supported portion 31*a* to enter the securing space 41*a* of the bracket 4*a* through the gap 43*a*. Afterward, the outer cover 3*a* is rotated again to prevent the supported portion 31*a* from falling out through the gap 43*a*, and the insert plate 5*a* is inserted into the space between the wheel-shaped cover 2*a* and the outer cover 3*a* to complete the installation process, which, although not shown in the drawings but only briefly stated as above, should be readily understandable to those who have read the description of the first embodiment.

The foregoing description of the embodiments should be able to enable a full understanding of the operation, use, and effects of the present invention. The embodiments described above, however, are only some preferred ones of the invention and are not intended to be restrictive of the scope of the invention. All simple equivalent changes and modifications that are based on the appended claims and the present specification should fall within the scope of the invention.

What is claimed is:

1. An insert plate-assisted roller securing device, provided at an end of a roller, the insert plate-assisted roller securing device comprising:

a circular cover coupled to the roller;

an outer cover coupled to the circular cover, wherein the outer cover has a supported portion, and the supported portion has a first width in a first radial direction of the outer cover and a second width in a second radial direction of the outer cover;

a bracket having a securing space for receiving the supported portion of the outer cover and a gap in communication with the securing space, wherein the gap has a width less than a greatest width of the securing space, the first width is in a range between the width of the gap and the greatest width of the securing space, and the second width is less than or substantially equal to the width of the gap, wherein the supported portion is configured to be inserted into the securing space through the gap responsive to the supported portion being positioned with the second width being disposed in correspondence with the width of the gap, wherein the outer cover together with the roller is configured to be secured to the bracket responsive to rotation of the outer cover to position the second width of the supported portion to correspond to a direction transverse to a direction of the gap, and an insert plate, coupled to the circular cover, disposed in the gap of the bracket to form a closure therefrom.

2. The insert plate-assisted roller securing device of claim 1, wherein the circular cover has at least one hole, and the insert plate has a protuberance corresponding to and engaged in the hole.

3. The insert plate-assisted roller securing device of claim 2, wherein the wheel shaped circular cover has a first indicator portion and a second indicator portion, the circular cover has a third radial direction and a fourth radial direction, two pairs of holes are provided in a diametrically opposite radial direction of the third radial direction and in the fourth radial direction respectively, and the outer cover has a window; wherein when the first radial direction coincides with the third radial direction, the window corresponds to the first indicator portion, and the protuberance of the insert plate corresponds to and is engaged in the hole in the fourth radial direction; and wherein when the second radial direction coincides with the third radial direction, the window corresponds to the second indicator portion, and the protuberance of the insert plate corresponds to and is engaged in the hole in the diametrically opposite radial direction of the third radial direction.

4. The insert plate-assisted roller securing device of claim 1, wherein the outer cover has a position-limiting wall; the position-limiting wall, the supported portion, and the wheel-shaped cover form a position-limiting space: and when the supported portion is coupled in the securing space and the insert plate is coupled between the outer cover and the circular cover, both the bracket and the insert plate extend into the position-limiting space.

5. The insert plate-assisted roller securing device of claim 1, wherein the bracket has two opposing abutment surfaces adjacent to the gap, and the insert plate has a first lateral edge corresponding to the supported portion and a second lateral edge corresponding to one of the abutment surfaces.

6. The insert plate-assisted roller securing device of claim 1, wherein the circular cover has a first tubular portion, the outer cover has a second tubular portion, and the second tubular portion of the outer cover extends into the first tubular portion of the circular cover.

7. The insert plate-assisted roller securing device of claim 6, wherein the first tubular portion has a first coupling portion, the second tubular portion has a second coupling portion, and the first coupling portion and the second coupling portion are coupled together when the second tubular portion of the outer cover extends into the first tubular portion of the circular cover.

8. A roller, comprising:

a roller body;

a circular cover coupled to an end of the roller body;

an outer cover coupled to the circular cover, wherein the outer cover has a supported portion, and the supported portion has a first width in a first radial direction of the outer cover and a second width in a second radial direction of the outer cover;

a bracket having a securing space for receiving the supported portion of the outer cover and a gap in communication with the securing space, wherein the gap has a width less than a greatest width of the securing space, the first width is in a range between the width of the gap and the greatest width of the securing space, and the second width is less than or substantially equal to the width of the gap, wherein the supported portion is configured to be inserted into the securing space through the gap responsive to the supported portion being positioned with the second width being disposed in correspondence with the width of the gap, wherein the outer cover together with the roller body is configured to be secured to the bracket responsive to rotation of the outer cover to position the second width of the supporting position to correspond to a direction transverse to a direction of the gap. and an insert plate. coupled to the circular cover, disposed in the gap of the bracket to form a closure therefrom.

* * * * *